United States Patent [19]

Miram et al.

[11] B 3,983,446

[45] Sept. 28, 1976

[54] GRIDDED CONVERGENT FLOW ELECTRON GUN FOR LINEAR BEAM TUBES

[75] Inventors: George V. Miram, San Mateo County; Gerhard B. Kuehne, Santa Clara County, both of Calif.

[73] Assignee: Varian Associates, Palo Alto, Calif.

[22] Filed: July 6, 1971

[21] Appl. No.: 160,045

[44] Published under the second Trial Voluntary Protest Program on January 13, 1976 as document No. B 160,045.

[52] U.S. Cl. ..... 313/452; 313/456

[51] Int. Cl.[2] ..... H01J 29/02; H01J 29/46

[58] Field of Search ..... 313/82 R, 285, 292

[56] References Cited

UNITED STATES PATENTS

| | | | |
|---|---|---|---|
| 2,861,213 | 11/1959 | Dalman | 313/82 R X |
| 3,185,882 | 5/1965 | Dryden et al. | 313/83 |
| 3,255,374 | 6/1966 | Drees et al. | 313/292 X |
| 3,484,642 | 12/1969 | Kreuchen | 313/292 X |
| 3,484,645 | 12/1969 | Drees | 313/296 X |
| 3,558,967 | 1/1971 | Miram | 313/3.5 |
| 3,651,360 | 3/1972 | Sommeria | 313/82 R |

FOREIGN PATENTS OR APPLICATIONS

| | | | |
|---|---|---|---|
| 1,919,451 | 11/1969 | Germany | 313/82 R |

*Primary Examiner*—Robert Segal

*Attorney, Agent, or Firm*—Stanley Z. Cole; Robert K. Stoddard; Richard B. Nelson

[57] ABSTRACT

The electron gun includes a spherically concave cathode emitter with a pair of axially spaced spherically concave focus and control grids closely spaced overlaying the cathode emitter for controlling the beam current. The grids are supported from a common thermally conductive tubular grid support structure via the intermediary of first and second annular members one of which is a thermally conductive insulator. One or more of the grids are serrated about their peripheries to define a plurality of radially directed fingers bonded to the end of a respective annular grid support member. In an alternative embodiment, the end of the annular grid support member, as bonded to the serrated grid, is castellated to accommodate differences in thermal expansion between the grid and the annular grid support member.

5 Claims, 6 Drawing Figures

FIG. 1
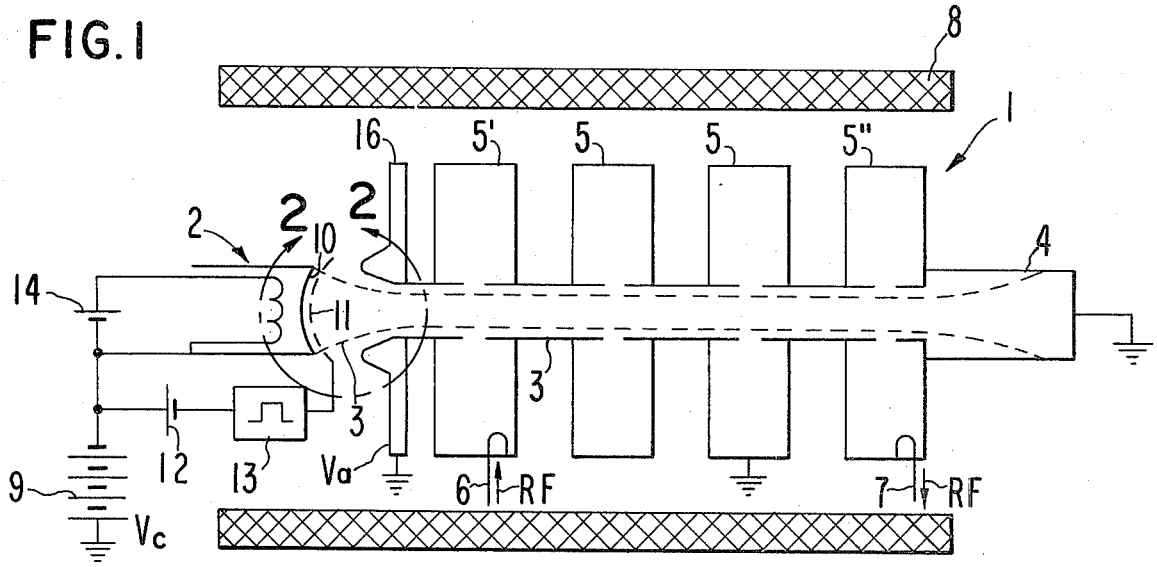
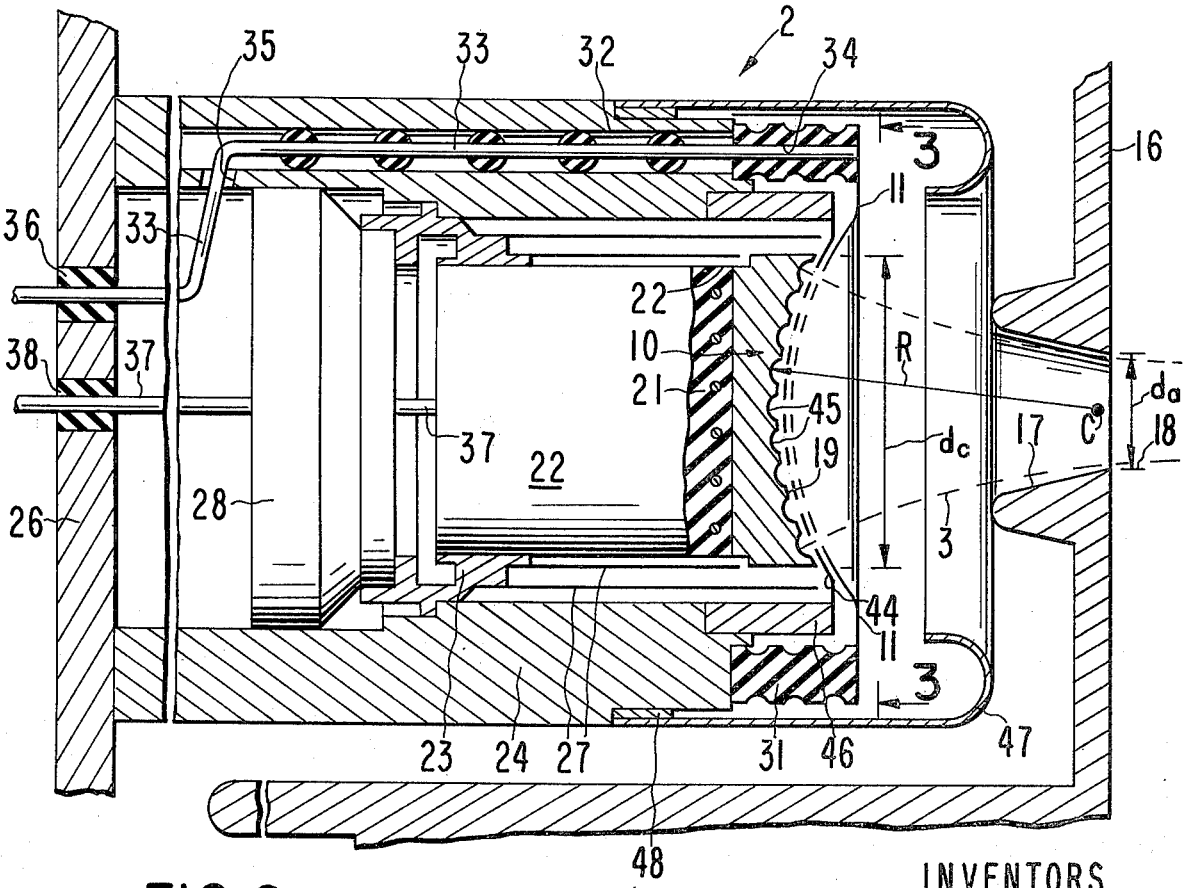
FIG. 2
INVENTORS
GEORGE V. MIRAM
GERHARD B. KUEHNE
BY Stanley Z. Cole
ATTORNEY FIG. 3
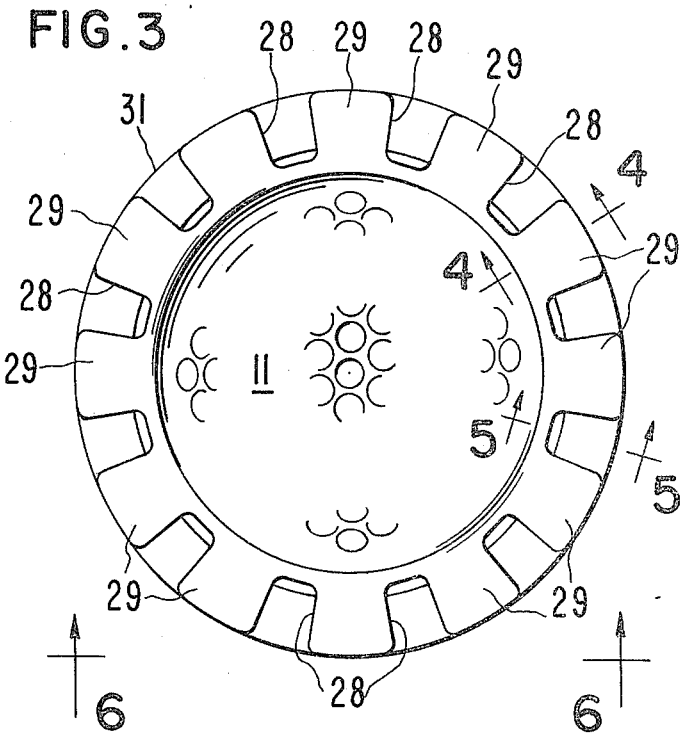
FIG. 4
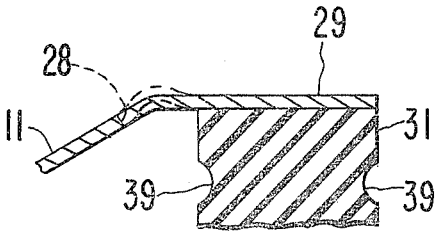
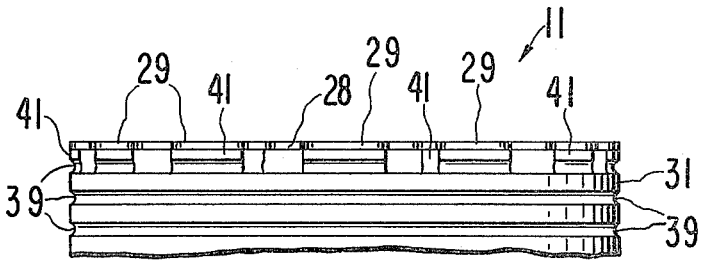
FIG. 6
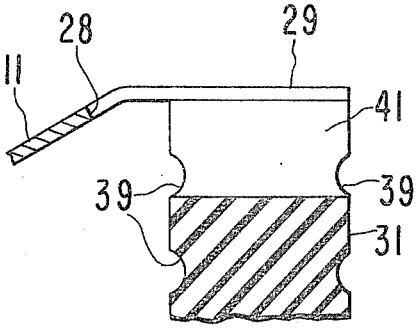
FIG. 5
INVENTORS
GEORGE V. MIRAM
GERHARD B. KUEHNE
BY Stanley Ross
ATTORNEY

GRIDDED CONVERGENT FLOW ELECTRON GUN FOR LINEAR BEAM TUBES

DESCRIPTION OF THE PRIOR ART

Heretofore, microwave linear beam tubes have been built employing an electron gun assembly having a concave emitter with a concave control grid closely spaced overlaying the surface of the emitter for controlling the beam current. In this prior electron gun, the control grid was supported at its periphery from a thermally conductive support structure to reduce the operating temperature of the grid to minimize the thermionic emission therefrom. This electron gun also included a shadow grid structure interposed between the control grid and the cathode emitter for focusing the electrons emitted from the cathode through the apertures of the control grid in a substantially non-intercepting manner. The shadow grid structure was supported at its periphery from a separate thermally conductive grid support structure operating at cathode potential. This support structure served to facilitate cooling of the shadow grid to reduce thermionic emission therefrom. Such a prior art electron gun is disclosed and claimed in U.S. Pat. No. 3,558,967 issued Jan. 26, 1971, and assigned to the same assignee as the present invention.

It is also known from the prior art to provide a center support for such grid structures by aperturing the cathode and providing a grid support post axially of the cathode with an insulator at the end thereof supporting the center portion of the control grid with a collar of the conductive post supporting the center portion of the focus or shadow grid. The center support provides physical support for the grids and provides a thermally conductive path for the removal of heat from the grid structures. Such a prior art electron gun is disclosed in U.S patent application Ser. No. 29,963, filed Apr. 20, 1970 and assigned to the same assignee as the present invention.

The problem with providing two separate tubular supports, one for the focus (shadow) grid and one for the control grid, is that the total grid support structure is unduly complicated and the probability is increased for introducing thermally produced unwanted dimensional variations in the spacing between the grids and/or their alignment. In addition, it would be desirable to provide means for relieving stress in the mounting of the grids to their support structure in such a manner that slight differences in expansion between the grid and support structure can be accommodated without producing distortion of the grid spacing or structure.

SUMMARY OF THE PRESENT INVENTION

The principal object of the present invention is the provision of an improved gridded convergent flow electron gun for linear beam tubes.

In one feature of the present invention, a control grid of the gun is bonded at its periphery to an electrically insulative thermally conductive grid support member forming a portion of an electrically conductive and thermally conductive grid support structure surrounding the cathode emitter.

In another feature of the present invention the periphery of one or more of the grids of the gun are serrated to define a plurality of radially directed fingers which are joined to the grid support structure, whereby thermally produced stress is relieved.

In another feature of the present invention, the grid support structure includes a tubular metallic member surrounding the cathode emitter in thermally insulative relation thereto, such tubular grid support member serving to support the grid via the intermediary of a thermally conductive annular ceramic insulator joined at one end to the tubular metallic grid support member and at the other end to the periphery of the grid.

In another feature of the present invention the grid is supported at its periphery via the intermediary of a castellated thermally conductive electrically insulative ceramic for relieving thermally produced stress between the grid and the supporting insulator.

In another feature of the present invention, a tubular metallic grid support member surrounds the cathode emitter in thermally insulative relation thereto, such grid support member also serving to support the cathode emitter therewithin. The tubular metallic grid support member is made of a material having a relatively low coefficient of thermal expansion, and a relatively high thermal conductivity and comprises a tungsten matrix impregnated with copper.

Other features and advantages of the present invention will become apparent upon a perusal of the following specification taken in connection with the accompanying drawings, wherein:

BRIEF DESCRIPTION OF THE DRAWINGS

FIG. 1 is a schematic line diagram, partly in block diagram form, depicting a high power linear beam tube incorporating features of the present invention, FIG. 2 is an enlarged detail view, partially foreshortened, depicting a portion of the structure of FIG. 1 delineated by line 2—2, FIG. 3 is a view of a portion of the structure of FIG. 2 taken along line 3—3 in the direction of the arrows, FIG. 4 is an enlarged sectional view of a portion of a structure of FIG. 3 taken along line 4—4 in the direction of the arrows, FIG. 5 is an enlarged sectional view of a portion of the structure of FIG. 3 taken along line 5—5 in the direction of the arrows, and FIG. 6 is an enlarged view of a portion of a structure of FIG. 3 taken along line 6—6 in the direction of the arrows.

DESCRIPTION OF THE PREFERRED EMBODIMENTS

Referring now to FIG. 1, there is shown a microwave linear beam tube 1 incorporating features of the present invention. The microwave tube 1 includes an electron gun assembly 2 for forming and projecting a beam of electrons 3 over an elongated beam path to a beam collector structure 4 disposed at the terminal end of the elongated linear beam 3. A plurality of cavity resonators 5 are successively disposed along the beam path for successive electromagnetic interaction with the electron beam passable therethrough. Although a klystron is shown, any type of linear beam tube may employ the electron gun of the present invention.

Microwave energy to be amplified is applied to the upstream cavity 5′ via an input coupling means, such as input coupling loop 6. The microwave energy in the input cavity 5′ velocity modulates the beam. The velocity modulated beam excites successive floating cavities 5 disposed along the beam path to produce current density modulation of the beam at the gap of the output resonator 5″. The current density modulated beam at the output gap excites the output resonator 5'' and output energy is extracted from the output resonator 5'' via suitable output coupling means, such as output coupling loop 7 which couples the energy to a suitable load, such as an antenna, not shown.

A solenoid 8 coaxially surrounds the tube 1 and beam 3 for producing an axially directed beam focusing magnetic field throughout the length of the beam path from the gun to the collector 4 for focusing the beam through the structures disposed along the beam path.

In the electron gun 2, a negative potential $V_c$, as of −10 KV, is applied to a cathode emitter 10 from a beam power supply 9. A control grid 11 overlays the cathode emitter 10 for controlling the beam current. The control grid 11 is biased negative relative to the cathode 10 by a relatively small DC bias voltage as of a few hundred volts supplied by a supply 12. The control grid 11 is pulsed positive relative to the cathode for turning on the beam via pulse power supply 13, thereby pulsing the beam current. A small current supply 14 is connected across the heater leads of the cathode emitter 10 for heating the cathode to thermionic emission temperature.

Referring now to FIG. 2, there is shown an electron gun assembly 2 incorporating features of the present invention. The electron gun 2 includes a centrally apertured anode 16, as of copper, having an outwardly flared entrance portion 17 leading into a constricted neck portion 18 forming the central aperture in the anode 16. The minimum diameter of the anode aperture $d_a$ defines the diameter of the beam passable therethrough. A spherically concave electron emissive surface 19 of the thermionic cathode emitter button 10 is disposed facing the flared entrance 17 of the anode 16. The emissive surface 19 has a radius of curvature R in the range of 0.6–1.2 times the diameter *dc* of the cathode emitter surface 19. In a typical example, the cathode emitter 10 is of the dispenser type comprising a porous tungsten body infiltrated with a cathode emissive material such as barium. A potted heater assembly 21 is disposed behind the cathode emitter 10 in heat exchanging relation with the cathode emitter 10 for elevating the emitter 10 to thermionic emissive temperature, as of 1100°C.

The beam 3, as it leaves the cathode emitter 10, has a maximum diameter $d_c$ which is substantially greater than the diameter $d_a$ of the aperture 18 $d_a$ of the anode 16 such that a substantial area convergence of the electron beam is obtained from its point of emission from the cathode surface 19 to the point at which it passes through the aperture 18 in the anode 16. In this manner, a convergent flow electron gun 2 is obtained having reasonable current density loading on the cathode emitter 10. A typical example of the beam voltage $V_a$ is +10 KV and the current emitted from the cathode emitter is 2 amperes with a current loading on the cathode, for example, of 4 to 5 amps per sq. centimeter.

The cathode emitter 10 is supported at its outer periphery by a relatively thin wall support tube 22 made of a refractory metal, such as 90% molybdenum and 10% rhenium and having relatively poor thermal conductivity. The support tube 22 is carried at its opposite end from an inwardly directed annular flange 23, which in turn is carried from the inside wall of a relatively thick walled tubular focus grid support member 24 having a relatively high thermal conductivity and low coefficient of thermal expansion, such as a copper impregnated tungsten matrix material comprising 20% by weight of copper and 80% by weight of tungsten and commercially available as 58W45 from Semicon Associates Inc. of Kentucky. The thermal coefficient of expansion of the copper impregnated tungsten member 24 is selected to produce a match to the thermal coefficient of expansion of beryllia ceramic, for reasons more clearly disclosed below.

The tubular grid support tube 24 extends axially of the tube and is joined at its base to a copper support member 25 which in turn is joined to an end portion or side portion of the envelope 26 of the gun 2 for conducting heat from the region of the cathode and grid structures to the surrounds of the electron gun 2. Thus, the tubular focus grid support member 24 provides a relatively highly thermally conductive path between the regions immediately surrounding the cathode structure and the surrounds of the electron gun 2.

The focus grid support 24 is thermally isolated from the cathode emitter 10 and its support 22 via the intermediary of a plurality of thin tubular heat shield members 27, as of molybdenum. Each shield member 27 is disposed surrounding the cathode emitter support 22 in concentrically radially spaced relation with respect to the cathode support 22. Each of the heat shielding members 27 serves to minimize transfer of heat from the cathode emitter 10 and heater 21 to the grid support tube 24. Thus, the grid support tube 24 is thermally isolated from the cathode 10 and heater 21 via the intermediary of the heat shields 27 and cathode support flange 23, as of molybdenum. A thin-walled conical heater lead support structure 28 is secured at its base to the grid support tube 24 and is connected at its inner end to the cathode support flange 23. The heater lead support 28 includes a transverse header and insulator for supporting and insulating the heater leads 37.

The cathode support cylinder 22 is dimensioned to have a length such that when the cathode emitter 10 and heater 21 are raised to their operating temperatures, as of 1100°C, the thermal expansion of the cathode support tube 22 is substantially equal to the axial thermal expansion of the grid support tube 24, which is then operating at a substantially lower temperature, as of 150°–200°C. In a typical example, the grid support tube 24 has a wall thickness as of 0.200 inch, the diameter of the cathode emitter 10 is 0.450 inch and the outside diameter of the grid support tube 24 is 0.825 inch.

The multi-aperture control grid 11, as of molybdenum or tungsten, is disposed overlaying the emissive surface 19 of the cathode emitter 10 in the space between the emitter 10 and the anode 16. The control grid 11 is shown in greater detail in FIG. 3 and has a generally spherically concave shape conforming to the spherically concave surface 19 of the cathode emitter 10. The control grid 11 is relatively closely spaced to the emissive surface 19 of the emitter, as by 0.039 inch, and the apertures in the multi-aperture grid 11 have a diameter, as of 0.100 inch. The web of the control grid 11 has a thickness of approximately 0.010 inch in the direction of the electron stream 3 and a thickness between adjacent apertures of approximately 0.010 inch. The apertures in the grid may comprise an array of closely packed circular apertures or the apertures may be hexagonally shaped.

The outer periphery of the control grid 11 is serrated at 28 to define a plurality of radially directed fingers 29

(see FIG. 4 and 6) which are bonded, as by brazing, to the free end of an annular ceramic support ring 31, as of beryllia ceramic, to provide an electrically insulative and thermally conductive support for the periphery of the control grid 11. In a typical example, the ceramic grid support ring 31 is of 0.825 inch outside diameter, 0.100 inch wall thickness and approximately 0.20 inch in length. The ceramic grid support ring 31 is brazed at one inner end via a butt braze to the end of the grid support tube 24. The butt braze between the ceramic grid support ring 31 and the grid support tube 24 provides a relatively highly thermally conductive joint therebetween to facilitate removal of heat from the control grid 11 via the intermediary of the ceramic support 31 and the grid support tube 24 to the surrounds of the electron gun 2. By making the grid support tube 24 of a material having a coefficient of thermal expansion substantially equal to that of the beryllia ceramic 31, namely with an expansion coefficient of 0.010 inch per thousand degree C per inch, the butt braze between the ceramic insulator 31 and the metallic grid support tube 24 is accommodated without introducing stress and strains in the insulator 31, either during the braze or in use.

The radially directed fingers 29 (see FIG. 3) at the periphery of the control grid 11 allow for slight differences in the thermal expansion of the grid 11 relative to that of its supporting insulator 31 without producing undue distortion of the control grid 11 or substantial changes in the spacing between the control grid 11 and the cathode emitter 10. In a preferred embodiment, the control grid fingers 29 have a peripheral width substantially greater than the width of the serrations 28 between adjacent fingers 29 to provide a relatively high thermal conductivity path between the grid 11 and the grid support tube 24 via the intermediary of the thermally conductive insulator 31.

The control grid insulator 31 is provided with a plurality of peripherally directed grooves 39 for increasing the electrical path length along the outside of the insulator 31 to reduce the possibility of shorting the control grid 11 to the grid support tube 24.

The control grid insulator 31 (see FIG. 2) permits an independent operating potential to be applied to the control grid 11 relative to the potential applied to the cathode emitter 10. An axially directed bore 32 is provided in the wall of the grid support tube 24 to accommodate a relatively thin control grid lead 33 insulated by insulative beads strung on the wire 33. The wire lead 33 passes through an aligned axially directed bore 34 in the control grid insulator 31 to the control grid 11. The control grid lead 33 passes out of bore 32 via a radially directed bore 35 and thence axially of the gun 2 through an insulator 36 hermetically sealing the control grid lead 33 to the end plate 26 closing off the end of gun 2. A heater lead 37 passes through an insulator 38 in end plate 26 and thence through heater support structure 28 to the heating element 21 within the cathode support cylinder 22. The other heater lead is common to the cathode 10 and grid support tube 24.

Referring now to FIG. 2, a multi-apertured focus grid (shadow grid) 44 having a configuration substantially conforming to the configuration of the control grid 11 is disposed immediately adjacent the emissive surface 19 of the concave cathode emitter 10. The focus grid 44 is made of molybdenum or tungsten. In a typical example, the focus grid 44 has a circular aperture or hexagonal aperture pattern conforming to the aperture pattern of control grid 11.

The emissive surface 19 of the cathode 10 is dimpled at 45 in registration with the apertures in the focus and control grids 44 and 11, respectively. The dimples 45 have a concave spherical curvature of a radius substantially smaller than the radius of curvature of the cathode emitter surface 19. The radius of curvature of the individual dimples 45 is chosen such that each individual dimple portion of the cathode 10 operates as a convergent electron gun such that the beam originating on the surface of each of the dimples passes through the aligned apertures in the focus grid 44 and control grid 11 in a substantially non-intercepting manner. In a typical example of an electron gun 2 of the present invention, the beam interception on the control and focus electrodes 44 and 11 is substantially less than 0.01% which permits operation at very high power levels.

The outer periphery of the multi-apertured focus grid 44 is fixedly secured, as by brazing, to the end of an annular focus grid support member 46, as of porous tungsten impregnated with 10% by weight of copper such that the focus grid support ring 46 has a thermal coefficient of expansion approximately equal to that of the material of the focus grid 44, such as molybdenum. In a typical example, the focus grid support ring 46 has a wall thickness as of 0.050 inch, a length of 0.200 inch and an outside diameter of 0.625 inch. The focus grid support ring 46 is brazed at one end to the outer periphery of the focus grid 44 and at its other end to the end of the grid support tube 24 to provide a relatively high thermally conductive path from the focus grid 44 to the grid support 24 and thence to the surrounds of the gun 2. Focus support ring 46 and control grid insulator 31 are dimensioned to have relative lengths such that their thermal expansions will be equal in use, such that the axial spacing between the focus grid 44 and the control grid 11 does not change in use.

In operation, the cathode 10 operates at a temperature of approximately 1100°C, and the focus grid support tube 46 operates at a temperature of approximately 200°C, whereas the outer periphery of the control grid 11 operates at a temperature of 150°C in a tube producing 10 KW of output power at 50% duty factor at X-band. In a tube of this power, a ± 10% change in the heater power produces approximately 0.1% change in the beam current which in-turn produces approximately ± 0.1% change in the amplification factor. In use, the control and focus grids 44 and 11, respectively, operate at temperatures less than 300°C such that no grid emission can take place. This eliminates or greatly minimizes the inter-pulse noise due to high control grid temperature and barium deposition, which otherwise causes grid emission.

A beam focus ring 47, as of tantalum, is fixedly secured to the grid support tube 24 via the intermediary of tungsten ring 48 which is brazed to the grid support tube 24 and to which the focus ring 47 is secured as by spot welding. The focus ring 47 is electrically connected to operate at cathode potential such that arcs within the gun 2 will be between the focus ring 47 and the anode and not between the control grid 11 and anode 16, thereby protecting the control grid pulse modulator 13.

What is claimed is:

1. In an electron gun; an evacuable envelope structure; thermionic cathode emitter means having a concave emitting surface generally approximating a figure of revolution for emitting a stream of electrons; an accelerating anode means spaced from said cathode emitter and having a central aperture of substantially smaller diameter than the diameter of the concave emitting surface of said cathode emitter, such anode central aperture being disposed in axial alignment with the axis of revolution of said concave emitting surface of said cathode emitter for accelerating and converging a stream of electrons through said aperture into a linear beam of electrons; a multi-apertured concave control grid means disposed overlaying said concave emitting surface of said cathode emitter in spaced relation therefrom for controlling the beam current drawn from said cathode through the apertures in said control grid means; control grid support means for supporting said control grid from the periphery thereof and disposed in electrically insulative and substantially thermally insulative relation relative to said cathode emitter means; said control grid support means being connected in heat exchanging relation with said control grid and including, a thermally conductive support structure surrounding said cathode emitter in thermally insulative relation thereto and thermally communicating through the evacuable envelope of the gun to the surrounds for conducting heat from said control grid to the surrounds of the electron gun and having an electrically insulative thermally conductive first portion interposed within said evacuable envelope in heat exchanging relation between the periphery of said control grid means and an electrically conductive second portion of said grid support structure, said second portion being in physical contact with a portion of said evacuable envelope, said second portion of said grid support structure includes a tubular metallic member surrounding said cathode emitter, and said first portion includes an annular ceramic member joined at one end to said tubular metallic second portion and at the other end to the periphery of said control grid means, a multi-apertured concave focus grid means interposed between said cathode emitter and said multi-apertured control grid means in thermally insulative relation relative to said cathode emitter for focusing the electrons drawn from said cathode emitter through the apertures in said multi-apertured control grid means, the apertures in said focus grid means being aligned along the direction of the convergent beam path with the apertures in said control grid means, a third portion of said grid support means being interposed in heat exchanging relation between the periphery of said focus grid and said second portion of said grid support structure for supporting said focus grid means, and wherein said second portion of said grid support structure is common to said control grid means and said focus grid means for defining a unitary support structure portion providing common support to both of said grid means.

2. The apparatus of claim 1 wherein said first and third portions of said grid support means include a pair of coaxially disposed annular support members each being affixed to the periphery of said respective grid means.

3. In an electron gun; an evacuable envelope structure; thermionic cathode emitter means having a concave emitting surface generally approximating a figure of revolution for emitting a stream of electrons; an accelerating anode means spaced from said cathode emitter and having a central aperture of substantially smaller diameter than the diameter of the concave emitting surface of said cathode emitter, such anode central aperture being disposed in axial alignment with the axis of revolution of said concave emitting surface of said cathode emitter for accelerating and converging a stream of electrons through said aperture into a linear beam of electrons; a multi-apertured concave control grid means disposed overlaying said concave emitting surface of said cathode emitter in spaced relation therefrom for controlling the beam current drawn from said cathode through the apertures in said control grid means; control grid support means for supporting said control grid from the periphery thereof and disposed in electrically insulative and substantially thermally insulative relation relative to said cathode emitter means; said control grid support means being connected in heat exchanging relation with said control grid and including, a thermally conductive support structure surrounding said cathode emitter in thermally insulative relation thereto and thermally communicating through the evacuable envelope of the gun to the surrounds for conducting heat from said control grid to the surrounds of the electron gun and having an electrically insulative thermally conductive first portion interposed within said evacuable envelope in heat exchanging relation between the periphery of said control grid means and an electrically conductive second portion of said grid support structure, said second portion being in physical contact with a portion of said evacuable envelope, said control grid means is serrated to define a plurality of radially directed fingers at the periphery of said control grid, and wherein said fingers are joined to said electrically insulative and thermally conductive first portion of said grid support structure, the peripheral extent of each of said fingers is greater than the space between adjacent fingers.

4. In an electron gun; an evacuable envelope structure; thermionic cathode emitter means having a concave emitting surface generally approximating a figure of revolution for emitting a stream of electrons; an accelerating anode means spaced from said cathode emitter and having a central aperture of substantially smaller diameter than the diameter of the concave emitting surface of said cathode emitter, such anode cnetral aperture being disposed in axial alignment with the axis of revolution of said concave emitting surface of said cathode emitter for accelerating and converging a stream of electrons through said aperture into a linear beam of electrons; a multi-apertured concave control grid means disposed overlaying said concave emitter surface of said cathode emitter in spaced relation therefrom for controlling the beam current drawn from said cathode through the apertures in said control grid means; control grid support means for supporting said control grid from the periphery thereof and disposed in electrically insulative and substantially thermally insulative relation relative to said cathode emitter means; said control grid support means being connected in heat exchanging relation with said control grid and including, a thermally conductive support structure surrounding said cathode emitter in thermally insulative relation thereto and thermally communicating through the evacuable envelope of the gun to the surrounds for conducting heat from said control grid to the surrounds of the electron gun and having an electrically insulative thermally conductive first portion interposed within said evacuable envelope in heat exchanging relation between the periphery of said control grid means an an electrically conductive second portion of said grid support structure, said second portion being in physical contact with a portion of said evacuable envelope, said second portion of said grid support structure includes a tubular metallic member surrounding said cathode emitter, and said first portion includes an annular ceramic member joined at one end to said tubular metallic second portion and at the other end to the periphery of said control grid means, said tubular metallic member is made of a copper impregnated tungsten matrix comprising by weight a preponderance of tungsten.

5. The apparatus of claim 4 wherein the copper comprises approximately 20% by weight of the metallic member.

* * * * *